US005682845A

United States Patent [19]

Woody

[11] Patent Number: 5,682,845

[45] Date of Patent: Nov. 4, 1997

[54] FUEL DELIVERY SYSTEM FOR HAND-HELD TWO-STROKE CYCLE ENGINES

[75] Inventor: John C. Woody, Caro, Mich.

[73] Assignee: Walbro Corporation, Cass City, Mich.

[21] Appl. No.: 725,775

[22] Filed: Oct. 4, 1996

Related U.S. Application Data

[60] Provisional application No. 60/007,142, Nov. 1, 1995.

[51] Int. Cl.[6] ..... F02B 33/04

[52] U.S. Cl. ..... 123/73 A; 123/73 C

[58] Field of Search ..... 123/73 A, 73 C, 123/73 AD, 305

[56] References Cited

U.S. PATENT DOCUMENTS

| | | | |
|---|---|---|---|
| 4,597,371 | 7/1986 | Wissmann et al. | 123/495 |
| 4,625,688 | 12/1986 | Takayasu | 123/73 C |
| 4,700,668 | 10/1987 | Schierling et al. | 123/73 C |
| 4,777,913 | 10/1988 | Staerzl et al. | 123/73 A |
| 4,807,573 | 2/1989 | Schierling et al. | 123/73 C |
| 4,813,391 | 3/1989 | Geyer et al. | 123/73 C |
| 4,835,866 | 6/1989 | Nagashima | 123/73 AD |
| 4,846,119 | 7/1989 | Geyer et al. | 123/73 C |
| 4,917,053 | 4/1990 | Okazaki et al. | 123/73 A |
| 4,932,370 | 6/1990 | Schierling et al. | 123/73 AD |
| 4,976,246 | 12/1990 | Schierling et al. | 123/509 |
| 5,138,984 | 8/1992 | Takashima | 123/73 A |
| 5,197,417 | 3/1993 | Tuckermann et al. | 123/73 C |
| 5,197,418 | 3/1993 | Wissmann et al. | 123/73 C |
| 5,251,582 | 10/1993 | Mochizuki | 123/73 C |
| 5,555,858 | 9/1996 | Katoh | 123/73 AD |

FOREIGN PATENT DOCUMENTS

| | | |
|---|---|---|
| 93218774.9 | 5/1994 | China . |
| 95202078.5 | 9/1996 | China . |

*Primary Examiner*—David A. Okonsky

*Attorney, Agent, or Firm*—Barnes, Kisselle, Raisch, Choate, Whittemore & Hulbert, P.C.

[57] ABSTRACT

An improved fuel delivery system, method and apparatus providing a hybrid carburetor and direct fuel injection system, utilizing the best of each for different engine operational modes to thereby meet emission requirements for small hand-held two-cycle engines using standard two-stroke gasoline and oil premix fuel. A diaphragm carburetor and associated diaphragm fuel pump operates alone to supply a proper A/F idle mixture sufficient only for engine power at start-up idle and off idle (light load). This engine aspiration carburetor fuel delivery system is operated continuously, and then at part (off idle-light load) and wide open throttle (W.O.T) the same is combined with operation of a direct cylinder fuel injection system, using a second stage pressure boost peristaltic type pump and fuel injector nozzle, that is engine self-regulated and driven to operate only at part-throttle and W.O.T. to thereby supply most of the engine fuel demand in these operational ranges. The remaining engine fuel requirement is satisfied by continuing delivery of the engine crankcase/carburetor aspirated idle air/fuel/oil mixture, which thus also provides engine lubrication under all operational conditions.

15 Claims, 4 Drawing Sheets

FUEL DELIVERY SYSTEM FOR HAND-HELD TWO-STROKE CYCLE ENGINES

This application claims the benefit under 35 USC §119 (e)(1) of provisional patent application Ser. No. 60/007,142 filed Nov. 1, 1995.

1. Field of the Invention

This invention relates to fuel delivery systems for internal combustion engines, and more particularly to fuel delivery systems for small two-stroke cycle crankcase-aspirating engines of the "hand-held" type, i.e., small, high speed two-stroke engines typically mounted on portable engine-powered appliances such as chain saws, string trimmers, leaf blowers, etc.

2. Background of the Invention

Pending and existing air pollution exhaust emission regulations imposed on engine-powered lawn and garden equipment powered by internal combustion engines by such governmental regulatory bodies as the California Air Resources Board (C.A.R.B.) and the Federal Environmental Protection Agency (EPA) recognize two types of such equipment, namely "hand-held" and "non-hand-held". Hand-held lawn and garden equipment typically includes such portable engine-powered appliances as chain saws, string trimmers, leaf blowers, etc., whereas non-hand-held lawn garden equipment typically includes lawn mowers, riding tractors, tillers, etc. Emission regulations for non-hand-held equipment differ from hand-held equipment.

With non-hand-held lawn and garden equipment, larger displacement engines are used which very seldom operate at wide open throttle (W.O.T.). Hence, emission regulations for testing this equipment typically requires that exhaust emissions be measured at several part throttle points, and the test procedure applies different weighting to the measurement values taken at the various measurement points to come up with a composite number that is very heavily weighted in the part-throttle operational range of the engine.

On the other hand, with hand-held engine-powered appliances, about 99% of which employ small single-cylinder two-stroke cycle engines of less than 50 cc displacement, typically their primary operational mode is high speed, usually running at wide open throttle, typically in the ten to twelve thousand rpm range under no load and six to ten thousand rpm range under load. Therefore the emission regulations for hand-held engines require that the emission testing be run only at wide open throttle full load and idle conditions, with the test results very heavily weighted toward the wide open throttle measurements because this is where the significant grams per hour of emission pollutants are created.

In order to meet such existing and pending air pollution exhaust emission regulations for such hand-held two cycle engines much effort and expense has been directed in the last several years toward improving fuel delivery systems for such engines to enable the same to meet such stricter exhaust pollution requirements, especially with regard to the unburned hydrocarbon (HC) component. In this field the major hurdle has been to achieve this result at an affordable cost to the ultimate purchaser and user of such relatively low cost equipment, while also insuring that such fuel delivery systems remain compact and light-weight in keeping with the easy portability requirement for such engine-carrying hand-held appliances and equipment.

Hitherto hand-held two-stroke cycle engines have employed a diaphragm-carburetor-type fuel delivery system, using a built-in crankcase-pressure-actuated diaphragm fuel pump, for engine-aspirating the requisite air/fuel mixture into the engine crankcase. Because of cost and weight limitations, lubrication of the engine crankcase is typically achieved solely by providing a mixture of gasoline and lubricating oil in the appliance fuel tank, typically in a 50 to 1 ratio so that the oil is entrained in the gasoline fuel/air mixture formed in the carburetor and thereby fed into the crankcase for lubricating the engine beatings of the crankshaft, connecting rod, etc.

It is also to be understood that such hand-held two-stroke cycle engines are almost always single cylinder and cylinder wall ported rather than moving-valve type engines. Hence when such self-aspirating crankcase carburetor fuel induction systems are used in such engines, the fuel/air mixture is first drawn into the crankcase where it is compressed as the piston travels on its power/exhaust stroke of the cycle, and then forced from the crankcase into the engine combustion chamber via a transfer passage controlled by piston travel. The incoming charge must push combustion products out of the exhaust port during the beginning of the intake/compression stroke of the engine cycle, in addition to supplying a combustible mixture for compression and ignition on this cycle stroke. However, as a practical matter the timing of this event cannot be made so exact or precise such that when the exhaust port is re-closed by piston travel toward TDC all of the burnt fuel has been pushed out without likewise exhausting any of the fresh charge being transferred into the combustion chamber. Inevitably some of the incoming raw (unburnt) air/fuel mixture charge escapes with the previous exhaust charge being expelled, thereby greatly increasing the HC level in the exhaust. It is primarily this unburned fuel in the exhaust (i.e. the carburetor-supplied fuel premixed with combustion air and then compressed in the crankcase for transfer to the combustion chamber) that has created the extreme emission problems with such engines equipped with conventional carburetor fuel delivery systems.

One prior approach to the solution of the aforementioned problems has been to provide various types of automotive direct fuel injection type fuel delivery systems wherein liquid fuel is directly injected from an injector nozzle into the combustion chamber to thereby supply 100% of engine fuel demand under all engine operating conditions, rather than delivering any or all fuel by crankcase aspiration and carburetor premix with the incoming engine combustion air. It is well recognized that such direct cylinder fuel injection systems can successfully meet the aforementioned HC exhaust emission requirements because 100% of the liquid fuel at idle, part throttle and wide open throttle is pressurized and fed through a fuel injector nozzle directly into the combustion chamber and can be precisely timed so as to enter either after the exhaust port has been closed or sufficiently close to such closing to avoid exhausting raw fuel.

However, so far as is known such 100% direct fuel injection systems previously attempted for hand-held two-stroke engines have not been successful in the marketplace, for a variety of reasons. A separate engine lubrication system with an associated oil supply tank, lubrication pump, etc. must be provided to meet engine crankcase lubrication requirements, thereby imposing undue cost, weight and space burdens which are impractical for such equipment. In addition, the operational demands imposed upon the fuel injector nozzle by such small displacement two-stroke engines are extreme. Under idle conditions the nozzle must meter in an extremely small amount of fuel through the nozzle, whereas at wide open throttle the nozzle must have enough capacity to handle all of the fuel required by the engine at wide open throttle. The cost and complexity of a fuel injector nozzle to meet these requirements thus has remained as another serious obstacle to successful implementation of direct fuel injection systems for hand-held two-stroke engines.

OBJECTS OF THE INVENTION

Accordingly, an object of the present invention is to provide an improved fuel delivery system, method and apparatus for two-stroke wall ported crankcase aspirated engines operating in a single cylinder mode, particularly such single cylinder hand-held engines of small displacement, i.e., generally less than 50 cubic centimeters, which is capable of meeting EPA and C.A.R.B. phase II hydrocarbon exhaust emission limits at a very low cost compared to previously proposed fuel delivery systems for this type of engine.

Another object is to provide an improved fuel delivery system, method and apparatus for hand-held engines of the aforementioned character which will successfully overcome the aforementioned problems while providing improved fuel economy, and which also provides engine lubrication without requiring a lubrication oil pump or oil tank, requires only a minimum modification to the existing engine designs, i.e., a fuel pump drive and nozzle access port, which utilizes existing state-of-the-art and commercially available components typically provided for diaphragm carburetors and diaphragm fuel pressure regulators, is engine driven without significant reduction in the engine available engine power to the appliance, does not impose an undue burden on the operational characteristics and costs of commercially available fuel injectors employed in the system despite the need of the engine to operate over a wide range of fuel delivery rates to the engine combustion chamber, and which is also rugged and reliable in operation, economical to manufacture and service and which does not add undue bulk and weight to the appliance-mounted engine components.

SUMMARY OF THE INVENTION

Generally speaking, and by way of summary description and not by way of limitation, the present invention achieves the aforementioned objects by providing an improved fuel delivery system, method and apparatus which is a hybrid of prior carburetor and direct fuel injection system, utilizing the best of each for different engine operational modes to thereby meet emission requirements for small hand-held two-cycle engines. The fuel used is a standard two-stroke gasoline and oil premix provided in the engine fuel tank. A diaphragm carburetor and associated diaphragm fuel pump operates alone to supply a proper A/F idle mixture sufficient only for engine power at start-up idle and off idle (light load). This engine aspiration carburetor fuel delivery system is operated continuously and then at part (off idle-light load) and wide open throttle (W.O.T.) the same is combined with operation of a direct cylinder fuel injection system, using a second stage pressure boost peristaltic type pump and fuel injector nozzle that is engine self-regulated and driven to operate only at part-throttle and W.O.T. to thereby supply most of the engine fuel demand in these operational ranges. The remaining engine fuel requirement is satisfied by continuing delivery of the engine crankcase/carburetor aspirated idle air/fuel/oil mixture, which thus also provides engine lubrication under all operational conditions.

BRIEF DESCRIPTION OF THE DRAWINGS

The foregoing as well as other objects, features and advantages of the present invention will become apparent from the following detailed description of presently preferred embodiments and the best mode presently known for making and using the invention, and from the accompanying drawings in which.

DETAILED DESCRIPTION OF THE PREFERRED EMBODIMENTS

Figure 1:
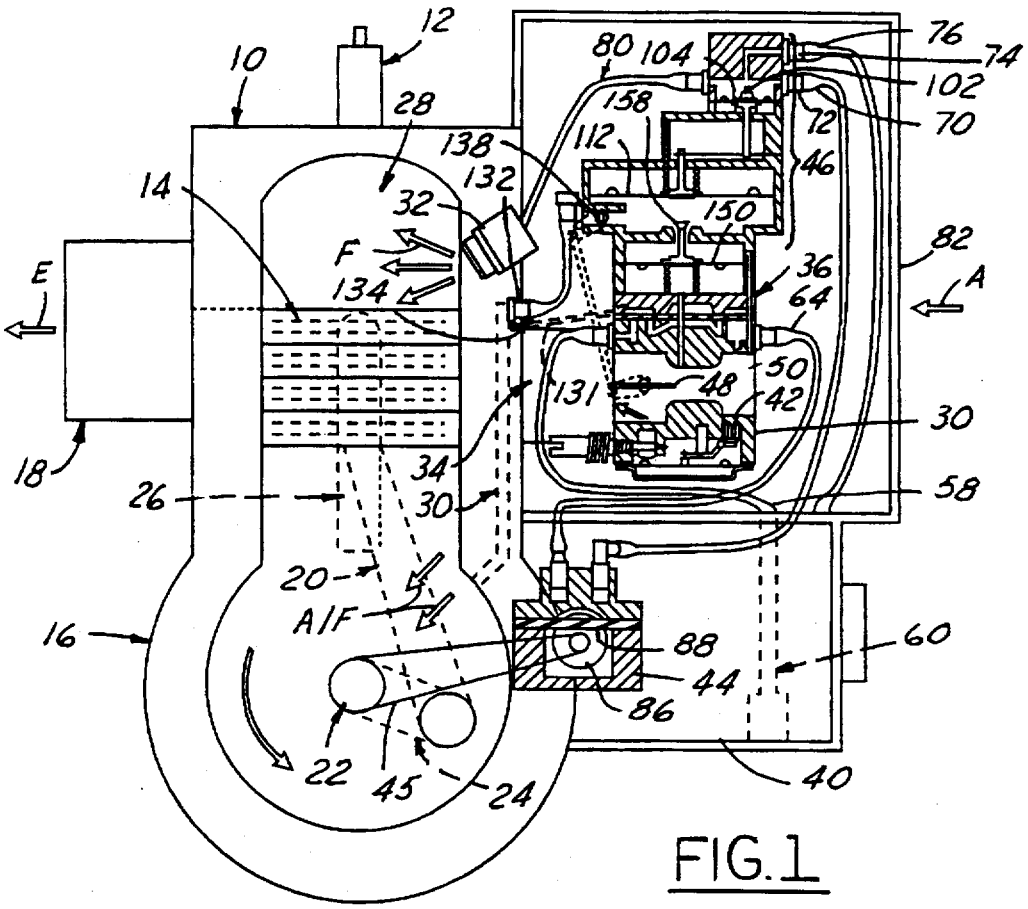
FIG. 1 is a semi-diagrammatic, semi-schematic simplified illustration, taken generally in vertical center section, of an exemplary but presently preferred first embodiment of the invention as applied to a small single cylinder two-stroke, wall ported, hand-held engine.

Referring in more detail to FIG. 1, the fuel delivery system of the invention is shown in a first embodiment as applied to a typical small displacement (e.g., less than 50 cc) single cylinder, two-stroke cycle wall ported, hand-held engine 10 provided with the usual spark plug 12 and associated conventional ignition system (not shown), a piston 14, crankcase 16, exhaust muffler 18, piston connecting rod 20 and engine crankshaft/drive shaft 22 with a crank arm 24 pivotally coupled to rod 20 and a transfer passageway 26 controlled by piston travel for communicating the

FUEL DELIVERY SYSTEM FOR HAND-HELD TWO-STROKE CYCLE ENGINES

This application claims the benefit under 35 USC §119 (e)(1) of provisional patent application Ser. No. 60/007,142 filed Nov. 1, 1995.

1. Field of the Invention

This invention relates to fuel delivery systems for internal combustion engines, and more particularly to fuel delivery systems for small two-stroke cycle crankcase-aspirating engines of the "hand-held" type, i.e., small, high speed two-stroke engines typically mounted on portable engine-powered appliances such as chain saws, string trimmers, leaf blowers, etc.

2. Background of the Invention

Pending and existing air pollution exhaust emission regulations imposed on engine-powered lawn and garden equipment powered by internal combustion engines by such governmental regulatory bodies as the California Air Resources Board (C.A.R.B.) and the Federal Environmental Protection Agency (EPA) recognize two types of such equipment, namely "hand-held" and "non-hand-held". Hand-held lawn and garden equipment typically includes such portable engine-powered appliances as chain saws, string trimmers, leaf blowers, etc., whereas non-hand-held lawn garden equipment typically includes lawn mowers, riding tractors, tillers, etc. Emission regulations for non-hand-held equipment differ from hand-held equipment.

With non-hand-held lawn and garden equipment, larger displacement engines are used which very seldom operate at wide open throttle (W.O.T.). Hence, emission regulations for testing this equipment typically requires that exhaust emissions be measured at several part throttle points, and the test procedure applies different weighting to the measurement values taken at the various measurement points to come up with a composite number that is very heavily weighted in the part-throttle operational range of the engine.

On the other hand, with hand-held engine-powered appliances, about 99% of which employ small single-cylinder two-stroke cycle engines of less than 50 cc displacement, typically their primary operational mode is high speed, usually running at wide open throttle, typically in the ten to twelve thousand rpm range under no load and six to ten thousand rpm range under load. Therefore the emission regulations for hand-held engines require that the emission testing be run only at wide open throttle full load and idle conditions, with the test results very heavily weighted toward the wide open throttle measurements because this is where the significant grams per hour of emission pollutants are created.

In order to meet such existing and pending air pollution exhaust emission regulations for such hand-held two cycle engines much effort and expense has been directed in the last several years toward improving fuel delivery systems for such engines to enable the same to meet such stricter exhaust pollution requirements, especially with regard to the unburned hydrocarbon (HC) component. In this field the major hurdle has been to achieve this result at an affordable cost to the ultimate purchaser and user of such relatively low cost equipment, while also insuring that such fuel delivery systems remain compact and light-weight in keeping with the easy portability requirement for such engine-carrying hand-held appliances and equipment.

Hitherto hand-held two-stroke cycle engines have employed a diaphragm-carburetor-type fuel delivery system, using a built-in crankcase-pressure-actuated diaphragm fuel pump, for engine-aspirating the requisite air/fuel mixture into the engine crankcase. Because of cost and weight limitations, lubrication of the engine crankcase is typically achieved solely by providing a mixture of gasoline and lubricating oil in the appliance fuel tank, typically in a 50 to 1 ratio so that the oil is entrained in the gasoline fuel/air mixture formed in the carburetor and thereby fed into the crankcase for lubricating the engine beatings of the crankshaft, connecting rod, etc.

It is also to be understood that such hand-held two-stroke cycle engines are almost always single cylinder and cylinder wall ported rather than moving-valve type engines. Hence when such self-aspirating crankcase carburetor fuel induction systems are used in such engines, the fuel/air mixture is first drawn into the crankcase where it is compressed as the piston travels on its power/exhaust stroke of the cycle, and then forced from the crankcase into the engine combustion chamber via a transfer passage controlled by piston travel. The incoming charge must push combustion products out of the exhaust port during the beginning of the intake/compression stroke of the engine cycle, in addition to supplying a combustible mixture for compression and ignition on this cycle stroke. However, as a practical matter the timing of this event cannot be made so exact or precise such that when the exhaust port is re-closed by piston travel toward TDC all of the burnt fuel has been pushed out without likewise exhausting any of the fresh charge being transferred into the combustion chamber. Inevitably some of the incoming raw (unburnt) air/fuel mixture charge escapes with the previous exhaust charge being expelled, thereby greatly increasing the HC level in the exhaust. It is primarily this unburned fuel in the exhaust (i.e. the carburetor-supplied fuel premixed with combustion air and then compressed in the crankcase for transfer to the combustion chamber) that has created the extreme emission problems with such engines equipped with conventional carburetor fuel delivery systems.

One prior approach to the solution of the aforementioned problems has been to provide various types of automotive direct fuel injection type fuel delivery systems wherein liquid fuel is directly injected from an injector nozzle into the combustion chamber to thereby supply 100% of engine fuel demand under all engine operating conditions, rather than delivering any or all fuel by crankcase aspiration and carburetor premix with the incoming engine combustion air. It is well recognized that such direct cylinder fuel injection systems can successfully meet the aforementioned HC exhaust emission requirements because 100% of the liquid fuel at idle, part throttle and wide open throttle is pressurized and fed through a fuel injector nozzle directly into the combustion chamber and can be precisely timed so as to enter either after the exhaust port has been closed or sufficiently close to such closing to avoid exhausting raw fuel.

However, so far as is known such 100% direct fuel injection systems previously attempted for hand-held two-stroke engines have not been successful in the marketplace, for a variety of reasons. A separate engine lubrication system with an associated oil supply tank, lubrication pump, etc. must be provided to meet engine crankcase lubrication requirements, thereby imposing undue cost, weight and space burdens which are impractical for such equipment. In addition, the operational demands imposed upon the fuel injector nozzle by such small displacement two-stroke engines are extreme. Under idle conditions the nozzle must meter in an extremely small amount of fuel through the nozzle, whereas at wide open throttle the nozzle must have enough capacity to handle all of the fuel required by the engine at wide open throttle. The cost and complexity of a type member cooperating with a plastic outer race (not shown) on eccentric 86 to eliminate undue wear.

Figure 2:
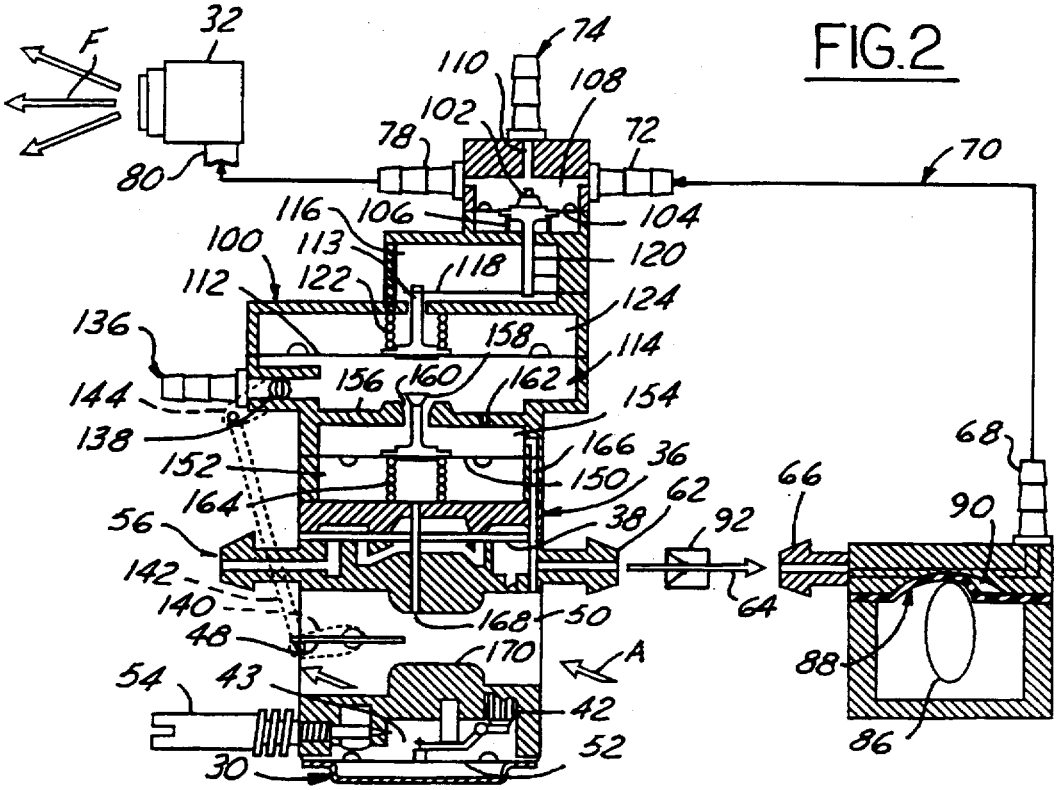
FIG. 2 is a similar illustration of certain components of the system of FIG. 1 but enlarged and simplified thereover to facilitate understanding of the invention.

As best seen in FIG. 2, regulator 46 of the invention comprises a suitably constructed housing 100 having a series of stacked diaphragm regulating chamber compartments and associated springs, linkages and regulating valves which cooperate with the built-in pre-set spring biased injector nozzle valve (not shown) to control the operation of the pressurized fuel feed from fuel injector nozzle 32. The top of housing 100 contains an injector bypass regulating valve 102 carried on a diaphragm 104 and normally biased upwardly by a coil spring 106 to closed position relative to a bypass passage 110. The valve closing force of spring 106 is set so that when the engine is cranked at engine start up and when the engine is running under its own power at idle and light load, valve 102 will open passage 10 at a lower pressure (e.g., 100 psi) than the set opening pressure (e.g., 125 psi) of the valve of injector nozzle 32. Hence under these conditions, all fuel flowing via line 70 through fitting 72 into valve chamber 108 bypasses outlet firing 78 and flows through bypass passage 110 and via line 76 back to tank 40.

Regulator 46 also has a primary bypass regulating diaphragm 112 which responds to the pressure conditions in a primary regulating chamber 114 to thereby cyclically augment spring closing force exerted on bypass valve 102 through a force-multiplying lever linkage. This linkage comprises a post 113 mounted centrally of diaphragm 112 and extending upwardly into a lever chamber 116 of housing 100. The upper end of post 113 is connected to the free end of a lever 118 cantilever pivoted at its other end on housing 100 remote from post 113. Lever 118 is connected to a stem connector 120 of valve 102 for forcing valve 102 upwardly as viewed in FIG. 2 towards closed position relative to passage 110. This occurs cyclically in response to cyclical upward flexing of diaphragm 112 caused by positive gas pressure pulses admitted to chamber 114 from engine crankcase 16. A coil spring 122 is disposed in a spring chamber 124 between the upper wall of chamber 124 and diaphragm 112 to normally bias diaphragm 112 to a central position as shown in FIG. 2 when gas pressure in chamber 114 is equalized to ambient atmospheric. Spring 106 likewise normally biases diaphragm 104 and valve 102 upwardly to a closed position from the open position shown in FIG. 2, as indicated previously.

Engine 10 is provided with a conventional pressure tap off passageway 130 (FIG. 1) which communicates at one end with engine crankcase 16 and its other end via a check valve 132 with the inlet of a hose line 134. The outlet end of line 134 is received on a nipple fitting 136 (FIG. 2) which communicates, via a throttle-linkage-controlled rotary valve 138, with primary regulating chamber 114. Typically, passageway 130 is already provided in engine 10 of this type, and communicates upstream of valve 132 via branch passageway 131 with the pressure pulse chamber of fuel pump 36. Check valve 132 operates to rectify crankcase pressure by communicating only positive pressure pulses to regulating chamber 114 via hose line 134, whereas both positive and negative crankcase pulses are communicated via passageway 130/131 to diaphragm pump 36.

Valve 138 is suitably linked by a crank arm 140 fixed on the throttle shaft controlling the position of throttle plate 48, and by a connecting rod link 142 pivotally connected at one end to arm 140 and at its other end to another crank arm 144 that rotates valve 138. When valve plate 48 is at its W.O.T. position shown in FIGS. 1 and 2, this interconnecting linkage likewise positions rotary valve 138 in its fully open position as shown in FIGS. 1 and 2. When throttle plate 148 is moved to its conventional idle setting position (e.g., rotated clockwise approximately 75° from its W.O.T. position shown in FIGS. 1 and 2) rotary valve 138 is likewise rotated to a shut-off condition. Hence rotary valve 138 operates to admit positive crankcase pressure pulses to primary regulating chamber 114 only when throttle plate 48 is positioned anywhere except idle and light load positions. Preferably, in the exemplary embodiment of FIGS. 1 and 2 rotary valve 138 is designed so that there is only a minimum flow restriction to crankcase pressure pulses even when throttle 48 is initially moved counterclockwise out of idle position so that valve 138 basically operates as a "on and off" valve as throttle 48 is moved out of and into idle position respectively. However, if desired, for certain applications as described in more detail hereinafter valve 138 can be suitably configured to operate as a variable restriction passageway to thereby vary flow cross section as a function of angular position of throttle 48, if further or alternative positive pressure peak modulating regulation is desired in chamber 114 in the operation of regulator 46.

Regulator 46 also includes a secondary regulating diaphragm 150 disposed between a spring chamber 152 and a pressure modulating chamber 154 and separated by a housing wall 156 from primary regulating chamber 114. Diaphragm 150 carries a valve member 158 which controls release of crankcase gas from chamber 114 past a valve seat 160 controlling a passageway leading from chamber 114 into chamber 154. A pressure relief bleed passage 162 is also provided in wall 156 for providing a restricted but constant pressure bleed-off communication between chamber 114 and chamber 154. A coil spring 164 biases diaphragm 150 upwardly as viewed in FIG. 2 to hold valve 158 in a normally fully open initial setting under pressure equilibrium conditions, i.e., at engine shut down.

Chamber 154 is also connected through an always-open passageway 166 leading to essentially atmospheric pressure at the upstream entrance of the carburetor mixing passage 50 (downstream of the usual air filter, not shown). Another always-open passageway 168 is connected between spring chamber 152 and the venturi throat 170 of carburetor 30. Due to these differential pressure sensing connections to chambers 154 and 152, valve 158 is moved toward closed position relative to valve seat 160 in response to increasing air flow through carburetor 30 (i.e., higher vacuum conditions at throat 170 relative to those at throat entrance 50). Valve 158 thus operates as a variable restrictive vent for chamber 114 to thereby regulate peak pressure in chamber 114 more closely to the parameter of mass air flow rate through carburetor 30 and hence through engine 10. If valve 158 should fully close under extreme wide open, maximum air flow conditions through the engine and carburetor 30, bleed passage 162 ensures that little or no pressure build up will occur in chamber 114 between successive engine cycles to thereby avoid integration of positive crankcase gas pulses admitted to chamber 114 via valve 138 and hence loss of regulation control by valve 158.

System Operation

In the operation of the above-described exemplary but preferred fuel delivery system and embodiment of FIGS. 1 and 2 in performing the method of the invention and in association with engine 10, at initial engine start up and when running at idle all of the fuel required to meet engine demand under these conditions is fed solely by engine aspirating operation of carburetor 30 in the manner of a typical two-stroke cycle engine with the air/gasoline/oil mixture aspirated into the engine crankcase 16 via carburetor 30. If desired to prime the engine for cold start, carburetor 30 may be provided with a conventional butterfly choke valve and associated choke control linkage (not shown) so as to cause the idle system of carburetor 30 to feed a rich start up mixture to the engine. Typically prior to release of the choke the throttle plate will be automatically or manually set to its idle position, (i.e., rotated 75° from the wide open throttle position of FIGS. 1 and 2) so as to induce the appropriate flow of idle fuel premix via idle ports 56 at a rate sufficient to cause the engine to run at idle speed and at light load.

Figure 4A:
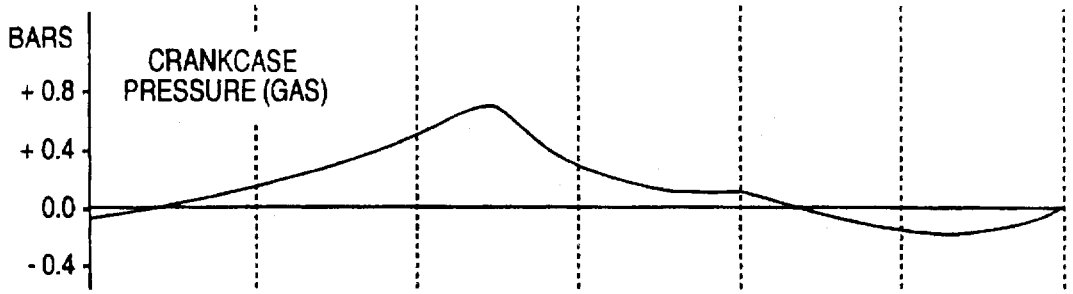
in FIG. 4A crankcase gas pressure, in FIG. 4B primary regulating chamber gas pressure.
Figure 4B:
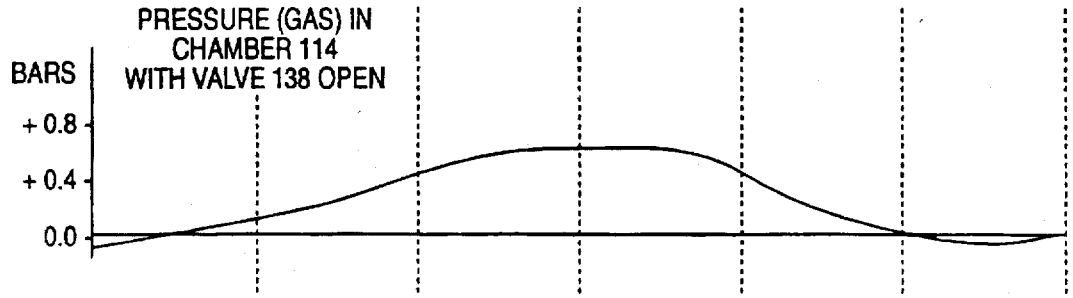
FIGS. 4 and 5 are composite stacked cartesian curve diagrams (sub FIGS. 4A, 4B, 4C, 4D, 5A, 5B, 5C and 5D) plotting the piston crank angle position (crank angle in degrees) of the engine of FIG. 1 during one complete cycle against.
in FIG. 4C boost pump liquid fuel output pressure (solid line) and liquid fuel output flow rate relative to boost pump output pressure (dash lines)
in FIG. 4D liquid fuel input pressure to the injector nozzle inlet.
Figure 4C:
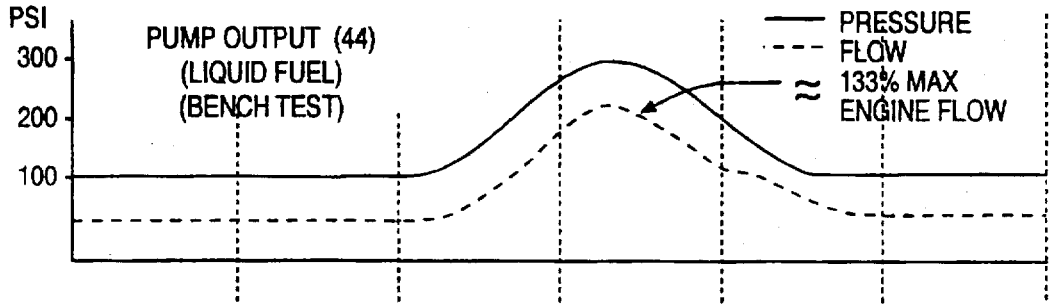

Reciprocation of piston 14 when cranked for starting and when the engine is running under its own power at idle RPM will produce the usual somewhat sinusoidal pattern of positive and negative pressure conditions in crankcase 16 in timed relation to piston reciprocation, as is well understood in the art and as shown for example in FIG. 4A. These positive and negative crankcase pressure conditions are transmitted via passageways 130 and 131 to the pressure chamber of the fuel pump 36 to cause pumping action of fuel pump diaphragm 38 to thereby pump fuel from fuel tank 40 via line 58 to thereby supply the fuel mix to the fuel supply chamber 43 of carburetor 30 under the control of inlet valve 42 and carburetor diaphragm 52. Typically fuel pump 36 is constructed to develop a pump output pressure ranging between 3 and 10 psi and typically averages about 6 psi in the fuel input to inlet valve 42. Pump 36 is also rated to supply an additional quantity of fuel at this pressure to the input of the positive displacement boost pump 44. Due to boost pump 44 being driven mechanically by timing belt 45 (or by gearing, not shown) directly by the engine crankshaft 22, pump 44 produces a pulsating output closely synchronized with the crank angle position of piston 14 (see FIG. 4C). Boost pump 44 preferably is timed to produce a "spike" or peak positive pressure of approximately 300 psi at about the 200° piston/crank angle position, i.e., at 160 crank angle degrees in advance of piston top dead center (TDC). The spark ignition event of engine 10 is also timed in a conventional manner by the engine-driven conventional ignition circuitry operably electrically coupled to spark plug 12, also in precise relation to the crank angle position of piston 14.

Figure 4D:
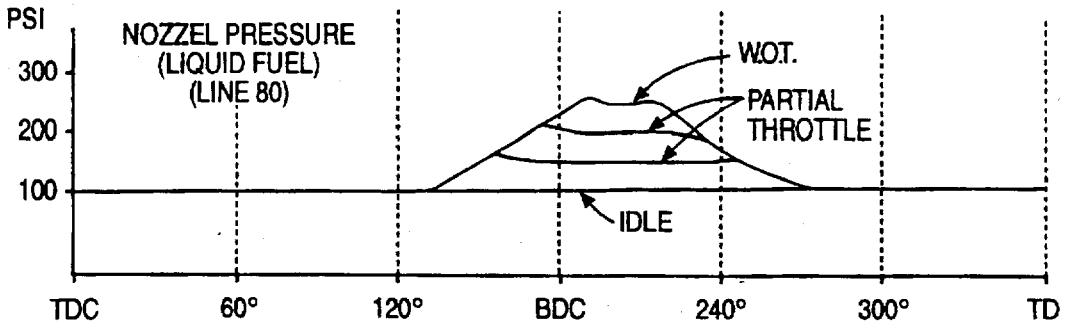

Fuel injector 32 is preferably a commercially-available gasoline engine-type fuel injector, such as Bosch Model No. Y 006 B50012, and contains an internal spring-biased outlet valve which can be set to open only at fuel input pressures to the injector in the range of say 125 to 175 psi. The bypass fuel pressure regulating valve 102 is designed so that, in the absence of the supplemental closing forces exerted on this valve by the lever linkage system 120, 118, 113 the fuel pressure in chamber 108 is kept below a predetermined value less than the minimum opening pressure of injector 32, for example 125 psi. Thus, until pressure of fuel in chamber 108 rises to at least 125 psi, flow out of the chamber to injector 32 is blocked by the injector valve contained in nozzle 32 (see FIG. 4D).

Under engine cranking start up and idle speed running conditions, the throttle-linkage-actuated rotary valve 138 is maintained closed to block admission of crankcase positive pressure pulses to regulating chamber 114 so that no supplemental closing force is developed on valve 102. Hence when the peak fuel pressure in chamber 108 rises above 100 psi during each fuel pressure pulse received from the output pump 44, the peak fuel pressure in chamber 108 acting on diaphragm 104 will force valve 102 open, thereby opening by-pass passage 110 to by-pass injector 32 and return to tank 40 all of the fuel received from pump 44 via line 70, until the output pressure of pump 44 drops back below 100 psi (see FIGS. 5A and 5B). Because injector 32 cannot open until pressure in chamber 108 reaches the set opening pressure of injector 32, say 125 psi, valve 102 and diaphragm 104 thus operate as a by-pass regulator relative to injector 32 so that no fuel is admitted to the combustion chamber 28 of engine 10 by injector 32. Rather, under these conditions 100% of the fuel delivered by pump 44 is returned to the fuel tank 40 via by-pass passage 110 and by-pass line 76 (see FIGS. 4D, 5A and 5B).

However, when throttle 48, under operator control, is rotated from idle position toward wide open throttle (W.O.T.) position, valve 138 is opened to admit the positive phase of crankcase pressure pulsations to regulating chamber 114. Assuming a low speed, part-throttle operating condition (engine 10 running at a speed above idle but below maximum RPM and under heavier than light load) it will be seen from FIG. 4B that a variable positive gas pressure will be produced in chamber 114, also of rectified sinusoidal nature per each cycle, i.e., one positive pulse per each complete engine cycle as crankcase pressure is rectified by check valve 132. These peak positive values are synchronized by engine operation with the crank angle position of piston 14 and thus are substantially in phase with the positive fuel pressure peak output spikes of pump 44 (compare FIGS. 4B and 4C). The rectified gas pressure pulse acting on regulator diaphragm 112 will tend to force the same upwardly as viewed in FIGS. 1 and 2, against the biasing force of spring 122, thereby exerting a force, acting through the connecting force-multiplying linkage 113, lever 118 and connector 120, on regulator valve 102 that is additive to the closing force exerted by spring 106 on valve 102. Hence valve 102 now can not open to by-pass fuel until the fuel pressure in chamber 108 reaches a predetermined corresponding higher value, say for example 130 psi. Hence when the pressure of fuel in chamber 108 rises to the pre-set opening pressure of injector 32, i.e., 125 psi, the internal valve of fuel injector 132 will open to allow fuel to be discharged from chamber 108 through injector 32 into combustion chamber 28 (see FIG. 4D).

Thus under such part throttle operational conditions of engine 10, the engine now receives fuel from two sources, namely (1) the idle air/fuel mixture engine-aspirated via carburetor 30 into crankcase 16 and delivered via transfer passage 26 to combustion chamber 28, and (2) the liquid fuel mixture directly injected into the engine cylinder combustion chamber 28 via fuel injector 32.

Typically the amount of fuel delivered by the idle system of carburetor 30 does not substantially increase despite opening of throttle 48 well beyond idle or light load part throttle (i.e., 10–15% of full load) positions when the flow of combustion air inducted through carburetor passage 50 increases in response to opening of throttle 48. For example, in many conventional carburetor designs the idle system flow rate is designed to increase slightly as throttle valve 48 is moved counterclockwise 10–15° out of the idle position (the 75° position clockwise from W.O.T. as seen in FIG. 2) before maximum idle flow rate is achieved, and in which position the main nozzle begins feeding fuel into venturi 170 in such conventional carburetor systems. However, during further counterclockwise rotation of throttle valve 48 from this light load, part throttle position to W.O.T. position, the fuel flow feed rate from the idle system remains essentially constant.

Figure 3:
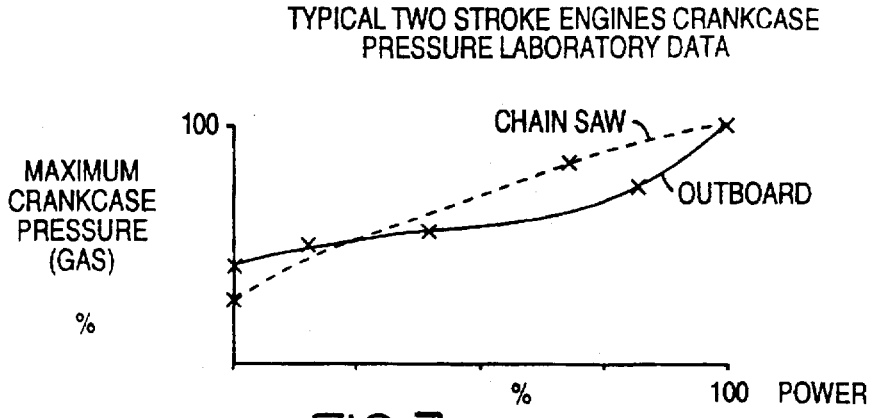
FIG. 3 are cartesian curves or plots of crankcase gas pressure (per cycle) against percentage of maximum power output of typical two-stroke engines, one curve (dash lines) being representative of the hand-held single cylinder two-stroke cycle wall ported engine type shown in FIG. 1 used for powering chain saws, and the other curve (solid line) being that for a typical small (e.g., 10 H.P.) outboard marine engine of the two-cylinder two-stroke cycle wall ported type wherein each cylinder and crankcase is isolated to operate in a single-cylinder two-stroke crankcase aspirated mode, respectively.
Figure 5A:
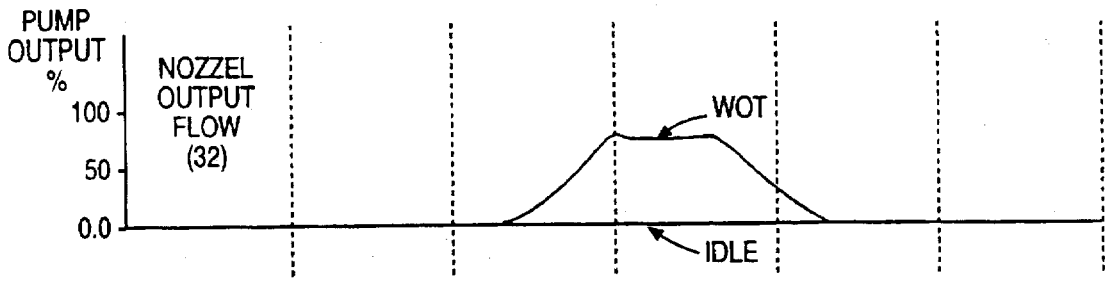
in FIG. 5A against injector nozzle output fuel flow delivery rate as a percentage of liquid fuel output of the boost pump at both idle and W.O.T. conditions.
Figure 5B:
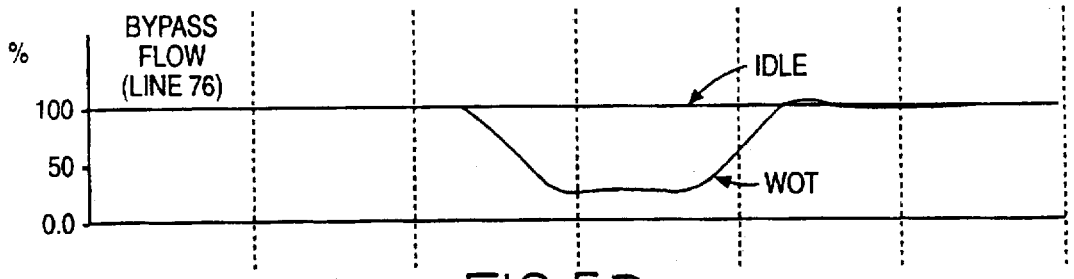
in FIG. 5B bypass liquid fuel flow from the system high pressure fuel pressure regulator back to the fixed tank at idle and W.O.T. conditions, also as a percentage of liquid fuel output of the boost pump.

On the other hand, in the system of the invention, the total amount of fuel delivered to combustion chamber 28 will increase during movement of throttle valve 48 in this 60° range to W.O.T. position due to onset of direct injection from fuel injector 32. In this range, the direct injection fuel delivery rate will vary with the operator setting of throttle 48, as desired to match engine power to load, because the operation of by-pass regulator 46 controls the ratio of fuel by-passed back to tank 40 versus that delivered to injector 32 (FIGS. 5A and 5B). This regulating effect results from the variation in supplemental closing force cyclically applied to by-pass regulator valve 102 by the synchronized application of the positive crankcase pressure pulsation forces applied to diaphragm 112 and multiplied via linkage 113, 118, 120. The magnitude of peak positive pressure pulses admitted by valve 138 to primary chamber 114 will vary directly with engine power output due to the corresponding direct variation in maximum crankcase pressure with engine power as seen in the curves of FIG. 3. Thus, in accordance with the system of the invention as embodied in the apparatus of FIGS. 1 and 2, this parameter of engine operation is sensed and utilized in the operation of regulator 46 to thereby vary the output of injector 32.

Figure 5C:
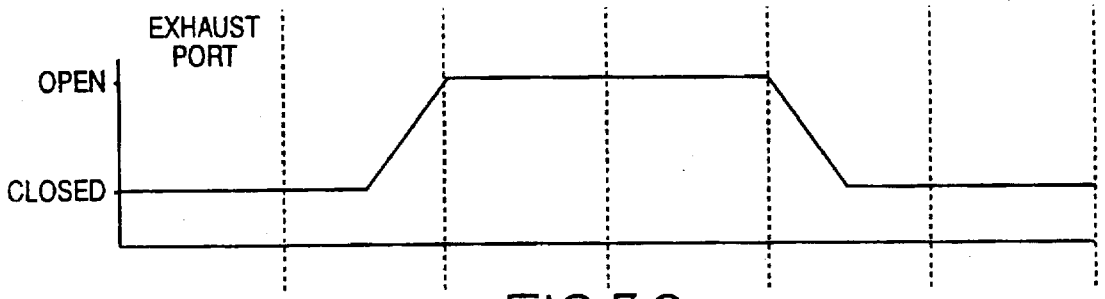
in FIG. 5C the relative extent of the exhaust wall port being opened and closed by piston travel; and in FIG. 5D gas pressure in the modulating chamber of the system pressure regulator (in inches of water) at W.O.T. (solid line curve), at partial throttle (dash line curve) and at idle (solid straight line curve)
Figure 5D:
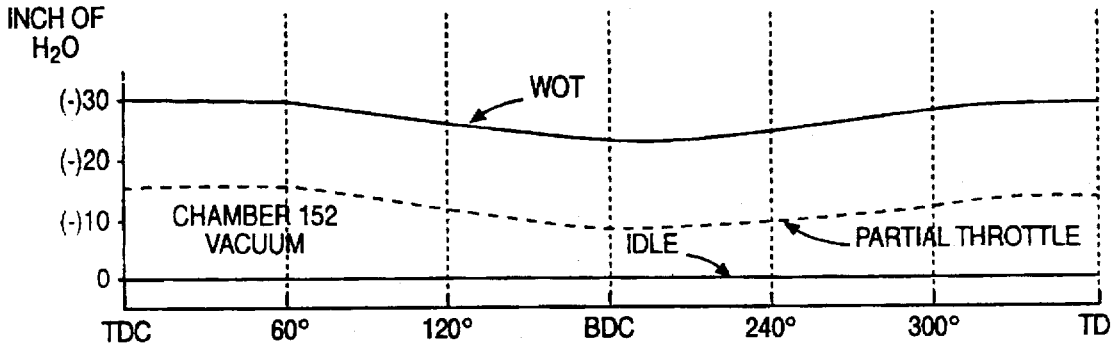

This variable injector fuel delivery rate in turn is preferably modulated by operation of vent valve 158 as positioned relative to pressure venting passage 160 and is dependent upon the operation of diaphragm 150 and its associated biasing spring 164. At relatively low rates of air flow through passage 50, corresponding to say the aforementioned part-throttle condition of engine operation, the pressure differential created by throat vacuum sensing passageway 168 communicating with chamber 152, versus atmospheric-pressure-sensing passageway 166 communicating with diaphragm chamber 154, will produce a net gas pressure force acting downwardly on diaphragm 150 (as viewed in FIGS. 1 and 2). This net differential pressure force is also cyclical and a function of piston crank angle position as shown in FIG. 5D but is generally more constant as compared to crankcase pulsations (FIG. 4B), and is applied substractively from the force exerted by spring 164 and hence tends to partially close valve 158 from its fully opened, pressure-equalized position. Vent valve 158 thus operates to limit and also impart a slight peak phase shift delay (compare FIGS. 4A, 4B and 5D) to thereby regulate peak positive gas pressure in chamber 114 by variably so venting pressurized crankcase gas from chamber 114 to chamber 154 (and thence, via passage 166 to the inlet of the carburetor mixture passage 50).

The magnitude of peak pressure achieved in chamber 114 during each engine cycle is thus also dependent upon the rate of air flow through carburetor passage 50, which in turn is also a variable generally directly dependent upon the level of power output of engine 10. When throttle 48 is moved to W.O.T. position the differential pressure acting on diaphragm 150 created by the increased rate of mass air flow through carburetor passage 50 will substantially or fully close valve 158. Therefore the positive pulse pressure in chamber 114 is allowed to reach a greater maximum value during each engine cycle, thereby exerting greater peak supplemental closing force on by-pass valve 102. It will be seen that the total closing force exerted on regulating valve 102 will thus be a variable directly dependent upon engine power output as controlled by throttle position, and is synchronized with the pressure spike from pump 44. Hence the ratio of fuel by-passed to tank 40 versus that delivered via fuel injection 32 will vary as throttle 48 is moved between 60° down from W.O.T. up to W.O.T. position to thereby vary engine power output (compare FIGS. 5A and 5B).

It is also to be understood that during each engine cycle, when throttle 48 is opened beyond idle position and hence valve 138 is opened to admit positive crankcase pressure pulsations to chamber 114, pressure build up in chamber 114 is limited to that engine cycle because of the variable but continuous venting of chamber 114 from one cycle to the next caused by the operation of vent valve 158. Even if and when valve 158 is fully closed, i.e., if such should occur in response to absolute maximum fuel flow under wide pen throttle conditions, bleed vent 162 will operate to prevent a pressure accumulation or build up occurring in chamber 114 from one engine cycle to the next. Hence the regulating effect of diaphragm 150 in controlling the supplemental closing forces developed in primary chamber 114 and exerted on by-pass valve 102 will remain dependent upon the various pressure conditions seen by each of the system elements during each engine cycle.

It will also be understood that the amount of fuel delivered by direct injection via fuel injector 32 is a function of both the pressure of fuel delivered to the injector as well as the time duration of the curve of peak pressure seen by the injector 32, which thus operates as a conventional "PT" type injector. Thus by regulating the pressure in chamber 108 in accordance with throttle/power setting, the higher cyclical fuel pressure developed by regulator 46 at the input to injector 32 at higher throttle settings will increase the quantity of fuel injected per engine cycle even as the duration of the fuel injection event decreases with increasing engine speed, and vice versa. It will also be remembered that the second-stage, pressure boosting pump 44 operates during each cycle to deliver a pulsating supply of high pressure fuel via line 70 to chamber 108. Although this reaches a potential maximum or a pressure spike of approximately 300 psi, there is sufficient difference between the opening pressures of valve 102 versus injector 32 to cause a pressure opening event of by-pass valve 102 during each cycle. Hence there is always some fuel by-passed back to tank 40 even at wide open throttle/full power conditions despite maximum supplemental closing force being added to valve 102 by the action of diaphragm 112 and its associated lever linkage system.

From the foregoing it will now be better understood that the fuel delivery system of the invention can be adjusted by system design to operate under wide open throttle/full power conditions such that preferably approximately 80% of the fuel delivered to combustion chamber 28 is supplied by direct injection via fuel injector nozzle 32. Likewise at W.O.T./full power only approximately the remaining 20% of fuel is delivered from the idle system of carburetor 30 through crankcase 16 and transfer passage 26 as a mixture of air and fuel to combustion chamber 28. Because injector 32 is timed by pump 44 to operate in relation to the crank angle position of piston 14, no fuel is injected from injector 32 until it is assured that no fuel will be lost through the cylinder exhaust port (compare FIGS. 5A and 5C). Hence there is no fuel lost to engine exhaust from this primary direct injection fuel source under part and wide open full power throttle settings.

Of course, there is still fuel lost to exhaust from the incoming carburetor-generated charge of air and fuel mixture expelled from crankcase 16 on the piston downstroke during that portion of the engine cycle when both the cylinder inlet transfer passage and exhaust port are simultaneously opened by piston travel to combustion chamber 28. However this fuel lost to engine exhaust (arrow E in FIG. 1) has now been reduced to approximately ⅕ of that normally occurring with a conventional 100% crankcase/carburetor-aspirated fuel supply to combustion chamber 28 of engine 10. Therefore, in accordance with the invention, the amount of raw fuel in the emissions developed in exhaust E at wide open full power throttle settings is reduced sufficiently to meet present and proposed emission standards for hand-held two-stroke cycle engines. In other words, although engine 10 is still operating to purge exhaust gases from the combustion chamber with incoming air that contains some fuel at wide open throttle, this purge air now only contains about 20% of the quantity of fuel it would have had if it were operating solely with a conventional carburetor with a carburetor main nozzle supplying substantially all of the fuel at wide open throttle. Thus in the system of the invention it will be seen that the injector nozzle 32 and its associated direct fuel injection system takes the place of, and thereby avoids the problem of raw fuel lost to exhaust from, the carburetor main nozzle of a conventional 100% carburetor-fed two-stroke cycle wall-ported engine.

It now will also be seen that under all engine operating conditions the premixed fuel of tank 40 will be supplied at a generally constant rate from the idle system of carburetor 30 to the crankcase 16 of engine 10 both at and between idle and W.O.T. engine running conditions. Therefore the engine crankcase will have adequate lubrication even at W.O.T., thereby eliminating the need for a separate engine crankcase lubrication system required by those engines provided only with 100% direct fuel injection for operating under all engine running conditions. Of course there is still the lubricating oil present in the gasoline directly injected into combustion chamber 28 via nozzle 32 to provide lubrication of the engine cylinder wall defining combustion chamber 28 and hence the upper rings and surfaces of piston 14.

It will also be noted that the hybrid fuel delivery system of the invention also overcomes the "turn down ratio" problems of fuel-injection-only systems. That is, the hybrid system of the invention does not require injector nozzle 32 to be small and precise enough to have good control of fuel delivery at the minute flow rate required by the engine when operating under idle speed and light load conditions. Thus it is not necessary to have a costly and complex fuel injector capable of operating over the entire fuel delivery range of the engine. Additional cost savings are provided by the system in terms of utilizing existing conventional diaphragm components, diaphragm fuel pump components as well as existing pressure regulator technology and components for fuel metering. Moreover, the only engine modifications required by the engine manufacturer are the provision of the nozzle access port for fuel injector 32, the timing belt 45 and associated boost pump drive elements, and the associated second stage, high pressure peristaltic pump 44. Perhaps most importantly, and unlike 100% direct fuel injection systems, there is no need for an engine lubrication oil pump nor associated engine lubrication oil tank.

The hybrid fuel delivery system of the invention also improves fuel economy of engine 10 compared to a conventional carburetor-feed-only two-stroke cycle engine, and achieves the primary direct fuel injection W.O.T. mode of operation while only requiring about 1% of the engine power available to the associated appliance in order to meet the torque and power requirements of high pressure fuel pump 44.

From the foregoing description it now will be apparent to those skilled in the art that the fuel delivery system of the invention amply fulfills the aforestated objects and provides many features and advantages while achieving a low cost fuel injection system capable of reliably meeting the urgent need to provide low cost small displacement two-stroke cycle engines for use in the hand-held marketplace that are capable of meeting present and proposed emission standards for this category of engine usage.

From the foregoing description it also will now be apparent to those skilled in the art that various modifications may be made to the fuel delivery system of the invention in order to better meet the differing engine operational characteristics required for a wide variety of hand-held engine power appliances now available in the marketplace. For example, the fixed orifice 162 for bleeding primary chamber 114 can be replaced by a bleed passageway having a variable flow controlling cross-section for end-user or engine manufacture adjustment by providing a conventional needle valve in association with such a passageway. This would enable end-user fine-tuning adjustment of the high speed air/fuel ratio delivered to the engine combustion chamber 28 to optimize engine operation to a given appliance application.

Figure 6:
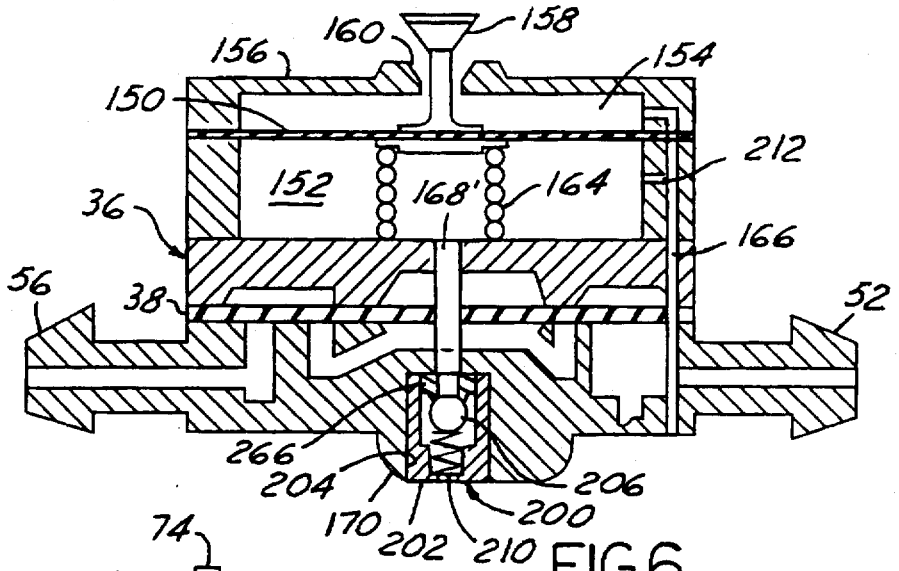
FIG. 6 is a semi-schematic simplified illustration, taken generally in vertical center section, of a second embodiment of the modulating section of the pressure regulator of the system embodiment of FIGS. 1 and 2 and useable therein.

FIG. 6 illustrates a further modification of the modulating section of the pressure regulator 46 of the system embodiment of FIGS. 1 and 2 and directly substitutable therein. In FIG. 6 those elements previously described are given like reference numerals and their description not repeated, and those elements alike in function to those previously described are given a like reference numerals raised by a prime suffix.

The modified modulator of FIG. 6 differs from that of FIGS. 1 and 2 in that a one-way check valve assembly 200 is provided in venturi sensing passageway 168'. Valve assembly may comprise a valve casing 202 press fit in a bore 204 formed into venturi section 170 of carburetor 30 and housing a valve seat 206, a valve ball 208 and associated compression coil valve spring 210. Valve 200 operates to allow air flow only downwardly from chamber 152 via passageway 168' into the carburetor throat, and prevents air flow in the reverse direction. The modified modulator regulator of FIG. 6 also includes a small restricted bleed passageway 212 communicating chamber 152 with atmospheric sensing passageway 166 to provide a constant bleed between chamber 152 and ambient atmospheric pressure at carburetor throat entrance 50.

Check valve 200 operates to maintain or hold the peak negative pressure sensed via passageway 168', generally occurring at piston top dead center (TDC), and which is imparted by engine operation to the mass air flow rate through the venturi of carburetor 30 at this point in the engine cycle. Since this peak negative pressure cannot be relieved via passageway 168', the peak vacuum value will be held during the engine cycle until piston travel reaches the vicinity of bottom dead center (BDC), when crankcase pressure (FIG. 4A) and hence positive pressure in primary chamber 114 approach maximum values respectively. Hence the peak pressure differential forces acting on modulating diaphragm 150 and controlling the position of vent valve 158 will be phased in more accurately with the peak regulating pressure developed in chamber 114 during each engine cycle. Vent passageway 212 is made small enough so that this vacuum pressure peak will be held in chamber 152 for substantially the entire engine cycle, but the continuous bleed provided by passageway 212 will nevertheless enable the vacuum pressure in chamber 152 to vary in response to the average venturi vacuum conditions over several engine cycles as sensed by passageways 168' and 166. The modified pressure regulator modulator of FIG. 6 thus compensates for the fact that peak positive and negative crankcase pressure values are generally 180° out-of-phase with one another and hence in chambers 114 and 152, and hence the same represents the presently preferred embodiment for use in regulator 46 in the system embodiment of FIGS. 1 and 2.

Figure 7:
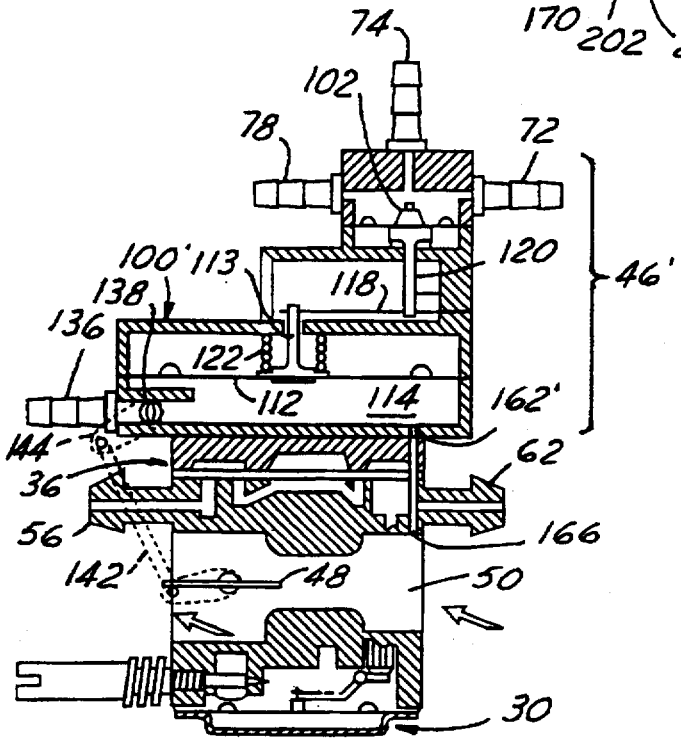
FIG. 7 is a semi-schematic simplified illustration, taken generally in vertical center section, of a simplified second embodiment of a pressure regulator for use in a modification of the system of FIGS. 1 and 2.

FIG. 7 illustrates a modified pressure regulator 46' which is simplified relative to the previously described regulator 46 of FIGS. 1 and 2, and is particularly adapted for this engine powered appliances where engine RPM and the engine-driven load are directly proportional as a linear or non-linear function of one another as a known in-use parameter. For example, leaf blowers having a fan directly driven by a hand-held engine, or outboard marine engines directly driving a propeller, generally fall into this category. In such applications the relationship of maximum crankcase pressure seen in FIG. 3 and expressed as a percentage of maximum power output can likewise be translated into a similar relationship between maximum crankcase pressure and engine RPM. Therefore the need to modulate primary regulating chamber 114 as a direct sensed function of mass air flow through the engine is no longer necessary.

In the modified pressure regulator 46' of FIG. 7 the throttle-controlled valve 138' is utilized as the primary regulating element and the modulating elements 150, 158, 164 and associated chambers 152 and 154 can be eliminated as a components from casing 100' the modified regulator. The bleed passage 162 is replaced by a bleed 162' communicating directly with sensing passageway 166. Valve 138' may be constructed and operated in the manner of valve 138 of the system of FIGS. 1 and 2 described previously to operate merely as a "on-off" valve so as to be closed when the engine is operating at idle and under light load conditions, and fully opened during part throttle and W.O.T. conditions as before. The peak positive pressure pulses emitted from the engine crankcase 16 to chamber 114 during such part throttle and W.O.T. conditions will thus vary in peak magnitude as some function proportional to engine RPM and load for the aforementioned leaf blower and marine outboard applications. Pressure regulator 46' then functions properly to control direct fuel injection via injector nozzle 32 without attempting to modulate pressure conditions in chamber 114 in accordance with mass air flow conditions in carburetor 30 as accomplished by diaphragm 150 and valve 158 in regulator 46.

In certain other applications utilizing small two-stroke cycle wall ported engines, and not necessarily for hand-held engine driven appliances, regulator 46' will also suffice for system operation. One example of this category of use is that of small generator sets where the applied load is generally defined by the position of throttle 48 of carburetor 30. In such applications regulator valve 138' can be suitably constructed in a conventional manner to provide a varying flow cross section controlling the flow passageway via nipple 136 to chamber 114 as a function of the position of throttle valve 48. Regulator 46' then functions to control the rate of fuel delivered by nozzle 32 as a direct function of throttle position thereby obviating the need to modulate pressure conditions in chamber 114 as a function of mass air flow through engine 10. In this modification the regulating system also can be tuned by initial design to correlate the variation in the flow-controlling cross section provided by valve 138', as in turn controlled by the position of throttle 48, with the variation in maximum crankcase pressure as a function of engine power output as seen in FIG. 3, as will now be well understood by those skilled in the art from the foregoing disclosure.

I claim:

1. A fuel delivery system for a small two-stroke cycle, cylinder-wall-ported, crankcase-transfer passage aspirated reciprocating piston engine utilizing for fuel a standard two-stroke cycle gasoline and oil liquid premix fuel provided in an associated engine fuel tank, said system comprising carburetor subsystem means operable to supply to the engine cylinder via the engine crankcase and transfer passage a proper air-to-fuel ratio (A/F) idle mixture of the tank premix fuel with ambient air sufficient only for engine power at engine start-up idle and off idle (light load) and operable continuously to supply such A/F mixture to the engine during engine operation under all engine operation conditions, i.e. at engine start-up idle and part throttle (off idle-light load) and wide open throttle (W.O.T), direct cylinder fuel injection sub-system means for the engine and including a pressure boost fuel pump means and a cylinder fuel injector nozzle supplied by said pump means with the liquid premix fuel, and control means operably associated with said injector sub-system means to be engine self-regulated to cause direct cylinder fuel injection via said nozzle in timed relation to engine piston reciprocation only at part-throttle and W.O.T. to thereby supply most of the engine fuel demand in these operational ranges via said direct fuel injection sub-system, whereby the remaining engine fuel requirement is satisfied by continuing delivery of the engine crankcase/aspirated idle air/fuel/oil mixture from said carburetor sub-system means, thereby providing both carburetor-supplied fuel and direct injection fuel for different engine operational modes to thereby meet emission requirements and also providing engine lubrication from said sub-systems under all operational conditions.

2. The system of claim 1 wherein said fuel pump means comprises a peristaltic type membrane pump having a membrane defining a movable wall of a pumping chamber of said pump and a rotary eccentric element operably engagable with said membrane so as to produce a membrane squeezing pumping stroke once per revolution of said element, and drive means coupling said element for rotation by the engine in synchronism with engine piston reciprocation.

3. The system of claim 1 wherein said control means comprises a bypass regulator having a fuel pressure regulating chamber with an inlet communicating with an outlet of said pump, a first outlet communicating with an inlet of said injector nozzle and a second outlet communicating with a fuel return bypass conduit leading to the fuel tank.

4. The system of claim 3 wherein said bypass regulator comprises a diaphragm defining a movable wall between said regulating chamber and a gas pressure chamber of said regulator, and a bypass valve that is spring-biased toward closure of said second outlet and also likewise movable by said diaphragm for regulating fuel flow from said regulating chamber via said second outlet to thereby bypass regulate fuel pressure in said regulating chamber, and diaphragm regulator means for causing engine crankcase positive gas pressure pulsations to act on said diaphragm in a direction tending to close said bypass valve in response to piston-reciprocation-induced positive pressure pulsations in the engine crankcase.

5. The system of claim 4 wherein said bypass diaphragm regulator means includes a passage for communicating crankcase pressure pulsations from the engine crankcase to said regulator gas pressure chamber, one-way pressure rectifier check-valve in said passageway closing toward the crankcase and opening toward the gas pressure chamber, and a gas pressure flow-controlling rotary valve in said passageway operably coupled with a control linkage of a rotary throttle of the carburetor sub-system of the engine for closing said passageway at throttle settings at or below part throttle (off idle-light load) and vice versa.

6. The system of claim 5 wherein said diaphragm regulator means includes first vent means for venting positive gas pressure from said regulator gas pressure chamber to ambient atmosphere at a controlled bleed rate during each cycle of engine piston reciprocation.

7. The system of claim 6 wherein said diaphragm regulator means includes second vent means comprising a venting passageway and a control venting valve operable therein for controllably venting positive gas pressure from said regulator gas pressure chamber to ambient atmosphere as a function of mass air flow rate inducted into the engine crankcase via said carburetor subsystem means.

8. The system of claim 7 wherein said second vent means includes spring means for biasing said control venting valve toward opening of said venting passageway and a modulator diaphragm coupled to said control venting valve and operably associated spring means for modulating the valve opening force exerted on said control venting valve by said spring means, and modulating passageway means for communicating a venturi region of a throat of the carburetor means to said modulator diaphragm such that venturi subatmospheric air pressure acts on said modulator diaphragm in a direction tending to close said control venting valve against the valve-biasing force of said spring means.

9. The system as set forth in claim 8 wherein said modulating passageway means includes a one-way check valve for opening said modulating passageway in response to occurrence of a pressure differential therein tending to cause fluid flow therein toward the venturi and vice versa.

10. A method of injecting gasoline and oil premix fuel in a two-stroke engine of the cylinder-wall-ported, crankcase-transfer passage aspirated type adapted for powering a hand-held portable tool, the engine being equipped with a fuel injection PT nozzle having a spring-biased outlet valve, a high pressure fuel pump, a crankcase feeding carburetor and a piston and cylinder conjointly defining a combustion chamber and a crankcase wherein gas pressure is developed in response to movement of the piston, the method comprising the steps of:

(a) operably connecting the piston to mechanically drive the pump to provide a pulsating high pressure output of the pumped fuel in synchronism with cyclical piston reciprocation, (b) conducting the pump fuel output via a bypass pressure regulator to the injection nozzle, (c) conducting gas pressure from the crankcase to act on the bypass regulator for bypassing the pumped fuel in dependence thereon and for controlling fuel pressure for injecting into the cylinder via the nozzle and burning the same in the engine, (d) causing the bypass regulator to cooperate with pumped fuel pressure and the nozzle outlet valve for triggering the injection process and initiating the injection of fuel into the combustion chamber in response to an increase in the crankcase gas pressure caused by engine operational power output above start-up idle and off idle (light load), (e) regulating the gas pressure conducted from the crankcase which acts on the bypass regulator in dependence upon at least one of the following parameters; the rotational speed of the engine and the load on the engine, and (f) continuously aspirating an ambient air/gasoline/oil mixture into the combustion chamber via the carburetor and crankcase under all engine operating conditions and at a rate sufficient only for developing enough engine power for engine start-up idle and off idle (light load).

11. The method set forth in claim 10 wherein step (d) is performed by communicating the gas pressure from the crankcase to the bypass regulator only after a carburetor throttle of the engine is opened past a predetermined threshold value.

12. The method set forth in claim 11 wherein the communication of crankcase gas pressure to the regulator above the threshold value is varied in accordance with the carburetor throttle setting to thereby vary the extent of the crankcase gas pressure acting on the bypass regulator.

13. The method set forth in claim 11 wherein the injection process is triggered and the initiation of the injection of the pumped fuel from the bypass regulator is controlled by a phase shifted value of peak positive crankcase gas pressure acting on the bypass regulator.

14. The method as set forth in claim 11 wherein step (e) is performed by causing the mass air flow rate condition through the carburetor to be effective in modulating the regulating action of the bypass regulator as a function of engine power output.

15. The method as set forth in claim 14 wherein the pressure regulator is provided with a pressure regulating bypass valve spring-forced in a direction tending to reduce fuel bypassed from the regulator, and step (d) is further performed by causing crankcase gas pressure to increase closing force acting on the bypass valve, and step (e) is performed by causing an increase in carburetor mass air flow rate to increase closing force acting on the bypass valve.

* * * * *